US009637908B2

(12) United States Patent
Sisto

(10) Patent No.: US 9,637,908 B2
(45) Date of Patent: May 2, 2017

(54) DRAIN ASSEMBLY

(71) Applicant: Salvatore Sisto, Bradley Beach, NJ (US)

(72) Inventor: Salvatore Sisto, Bradley Beach, NJ (US)

( * ) Notice: Subject to any disclaimer, the term of this patent is extended or adjusted under 35 U.S.C. 154(b) by 140 days.

(21) Appl. No.: 14/638,634

(22) Filed: Mar. 4, 2015

(65) Prior Publication Data

US 2016/0258146 A1 Sep. 8, 2016

(51) Int. Cl.
*E03C 1/12* (2006.01)
*E03F 5/06* (2006.01)

(52) U.S. Cl.
CPC ..... *E03F 5/06* (2013.01); *E03F 2005/068* (2013.01)

(58) Field of Classification Search
CPC ..... E03C 1/284
USPC ..... 4/679–694
See application file for complete search history.

(56) References Cited

U.S. PATENT DOCUMENTS 6,397,408 B1 * 6/2002 Veloskey ..... E04H 4/1236 4/292
2007/0180602 A1 * 8/2007 Lin ..... E03C 1/262 4/287
2011/0185494 A1 * 8/2011 Beck ..... E03C 1/23 4/689

* cited by examiner

*Primary Examiner* — Lori Baker
(74) *Attorney, Agent, or Firm* — Gottlieb, Rackman & Reisman, PC

(57) ABSTRACT

A drain assembly that aids in maximizing the flow of water through a drain. The assembly includes a first coupling element, a drain plate connected to the first coupling that includes a body with a plurality of protrusions that are spaced from each other and extend from the body at a plurality of angles and a drain cover that is connected to the drain plate.

19 Claims, 5 Drawing Sheets

DRAIN ASSEMBLY

FIELD OF THE INVENTION

The present invention relates generally to plumbing fixtures and more particularly to a drain assembly.

BACKGROUND OF THE INVENTION

In general, drain assemblies are known. Depending on the device and/or plumbing being used in conjunction with the drain assembly, water can flow through openings or perforations of a drain assembly by gravity alone or may require additional water pressure to force the water through a drain. However, water regularly pools, for example, on a shower or tub floor or in a sink basin because the flow rate of water from a shower head and/or faucet is typically greater than the amount of water the drain assembly associated with the shower, sink or other fixture is capable of handling. In many situations, a vortex forms as water is attempting to pass through a drain assembly. However, because the angular momentum of water is unpredictable and can force water to the center of a drain assembly, the efficiency of water flow is regularly minimized. Additionally, debris such as hair, dirt or other particles regularly collect over the openings or perforations in the assembly, which can also effect water flow and rotation and in turn air flow preventing water to efficiently and effectively move through a drainage system.

SUMMARY OF THE INVENTION

The present invention is directed to a drain assembly that improves the flow of water by directing and maintaining the flow of water towards the outer periphery of a drain. In an embodiment, a drain assembly includes a first coupling element, a drain plate connected to the first coupling element that includes a body with a plurality of protrusions and a drain cover connected to the drain plate. The protrusions are spaced from each other and extend from the body at a plurality of angles. In an embodiment, the protrusions are fins that vary in size and shape.

In an embodiment, the assembly can further include a second coupling element that is connectable with the first coupling element, a sealing washer and a friction washer that is arranged between the first coupling element and the second coupling element.

In an embodiment, the body of the drain plate has an opening defining an inner periphery and the body extends from the inner periphery to an outer periphery.

In an embodiment, the first surface and the second surface of the body are sloped downward from the inner periphery toward the outer periphery of the body.

In an embodiment, each of the fins includes a sloped first end that slopes toward the second surface and a second end that extends vertically away from the second surface.

In an embodiment, the fins include a first pair of fins orientated in a first direction, a second pair of fins orientated in a second direction, a third pair of fins orientated in a third direction and a fourth pair of fins orientated in a fourth direction. In an embodiment, the first pair of fins are orientated at approximately an inner periphery of the body, the second pair of fins are spaced circumferentially toward the outer periphery of the body between the first pair of fins and the third pair of fins, the third pair of fins are spaced circumferentially toward the inner periphery of the body between the second pair of fins and the fourth pair of fins and the fourth pair of fins are spaced circumferentially between the third pair of fins and the first pair of fins toward the outer periphery of the body. In an embodiment, the first pair of fins each include a through bore for fastening the drain plate. In an embodiment, at least one of the pairs of fins has a width that tapers from a first end toward a second end.

In an embodiment, the present invention is directed to a drain plate that comprises a body that has a first surface and a second surface opposing the first surface with a plurality of protrusions extending from the second surface at a plurality of angles that are configured to aid in the flow of water through a drain assembly. Flow of water is maximized by controlling the vortex to maximize water drainage while allowing adequate volumes of air to be displaced from the drain by the water flow.

DETAILED DESCRIPTION OF EMBODIMENTS OF THE INVENTION

Figure 1:
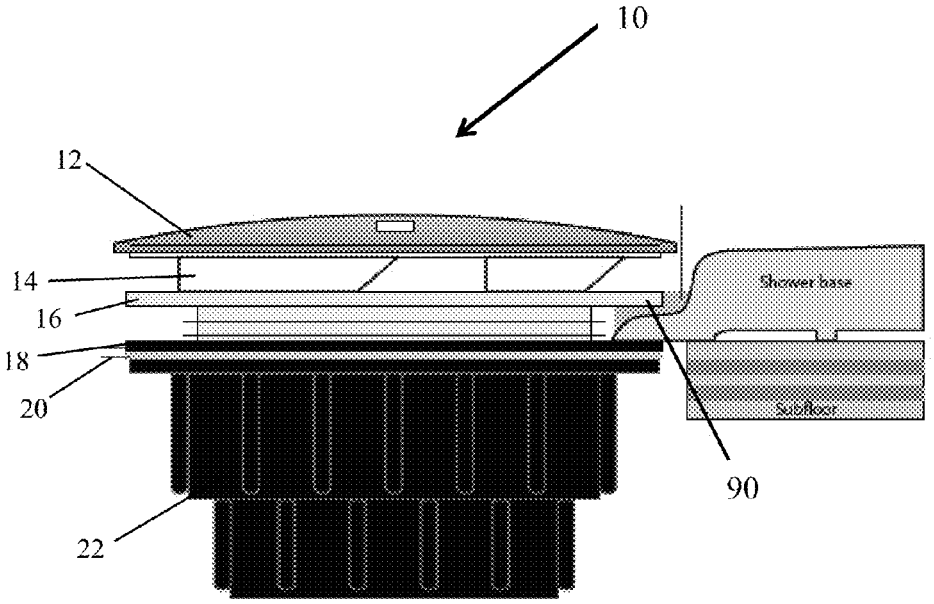
FIG. 1 is a side view of an embodiment of a drain assembly of the present invention.
Figure 3:
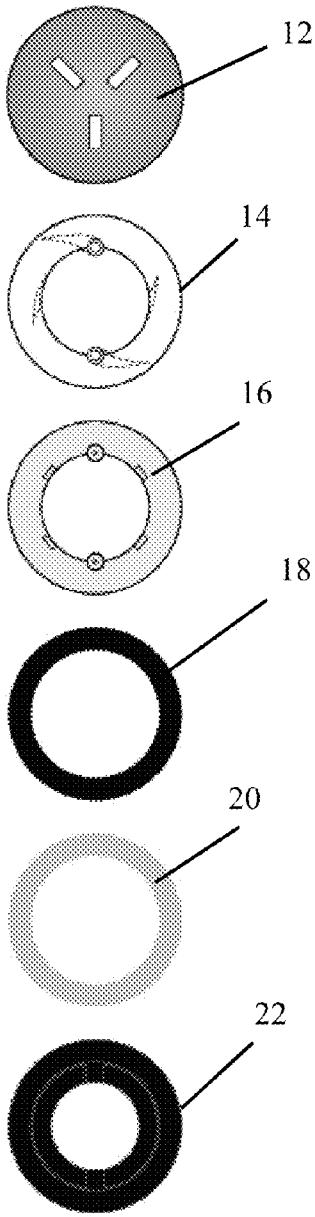
FIG. 3 is an exploded top elevational view of the drain assembly of FIG. 1.
Figure 2:
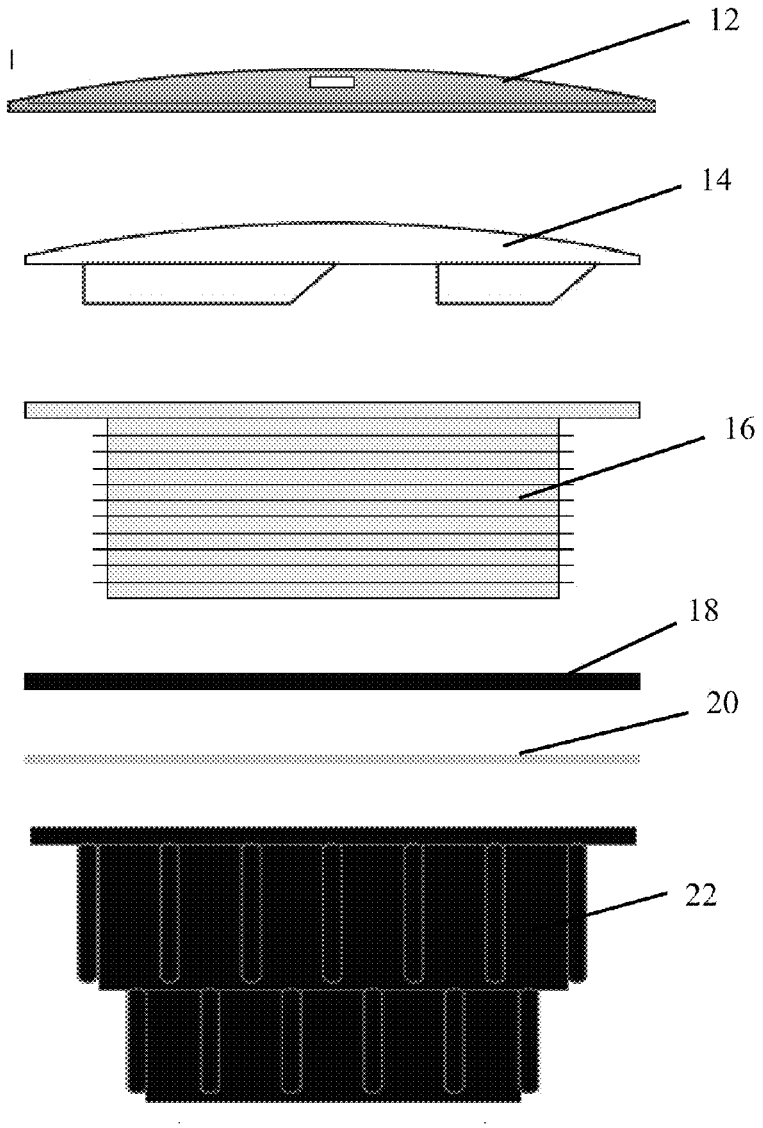
FIG. 2 is an exploded side elevational view of the drain assembly of FIG. 1.

FIGS. 1-7 illustrate an embodiment of a drain assembly, which is designated hereinafter by reference numeral 10. The drain assembly 10 includes a drain cover 12, a drain plate 14, a first connector 16, a sealing washer 18, a friction washer 20 for protection of the sealing washer 18, a second connector 22 and fasteners (not shown) for connecting the drain cover 12 and the drain plate 14 to the first connector 16.

To install the drain assembly 10, a bead of silicone is applied to the underside of a flange 90 of the first connector 16 to aid in keeping the drain assembly 10 water tight. The first connector 16 is then placed through a drain hole in a shower or tub base. From underneath the shower or tub base, the sealing washer 18 is slid over an outer periphery of the first connector 16 until it abuts a bottom portion of the shower or tub base. The friction washer 20 is then slid over the outer periphery of the first connector 16 until it abuts a bottom portion of the sealing washer 18. The second connector 22 is then fastened to the first connector 16 to ensure a secure connection between the drain assembly 10 and the shower or tub base.

The drain assembly 10 is designed to eliminate perforations in known drain covers that regularly collect debris while improving the gravitational flow of water by controlling the angular momentum of water rotation and in turn the flow of water around a circumference of the drain assembly 10 to displace air through the center of the drain assembly 10.

The drain plate 14 includes a body 24 that has a top surface 26 and a bottom surface 28 with a plurality of fins 30, 32, 34, 36, 38, 40, 42, 44 extending from the bottom surface 28 of the drain plate 14. By removing material from the drain plate 14, the fins 30, 32, 34, 36, 38, 40, 42, 44 create a quasi-vortex that more efficiently and effectively controls the movement of water as the spiral extent of the vortex is maintained near the external diameter of the drain assembly 10 to allow air to be displaced and escape upwardly through the center of the drain assembly 10; as water enters the drain, air in the system is displaced. As such, by improving the flow dynamics and forcing the vortex outwardly, the gravitational flow of water through the assembly 10 is maximized.

As shown in an embodiment FIGS. 1-7, the body 24, which can have a width of approximately 0.75 inches, is circular and defined by an inner periphery and an outer periphery. The top surface 26 and the bottom surface 28 both slope downwardly from the inner periphery toward the outer periphery to aid in drainage of water. In an embodiment, the drain plate 14 has an outer diameter (outer periphery) of approximately 4.25 inches and inner diameter (inner periphery) of approximately about 2.75 inches. However, the drain plate 14 can take the form of any shape that is known or may become known and can be of any size to mate with an associated drain assembly.

Figure 5:
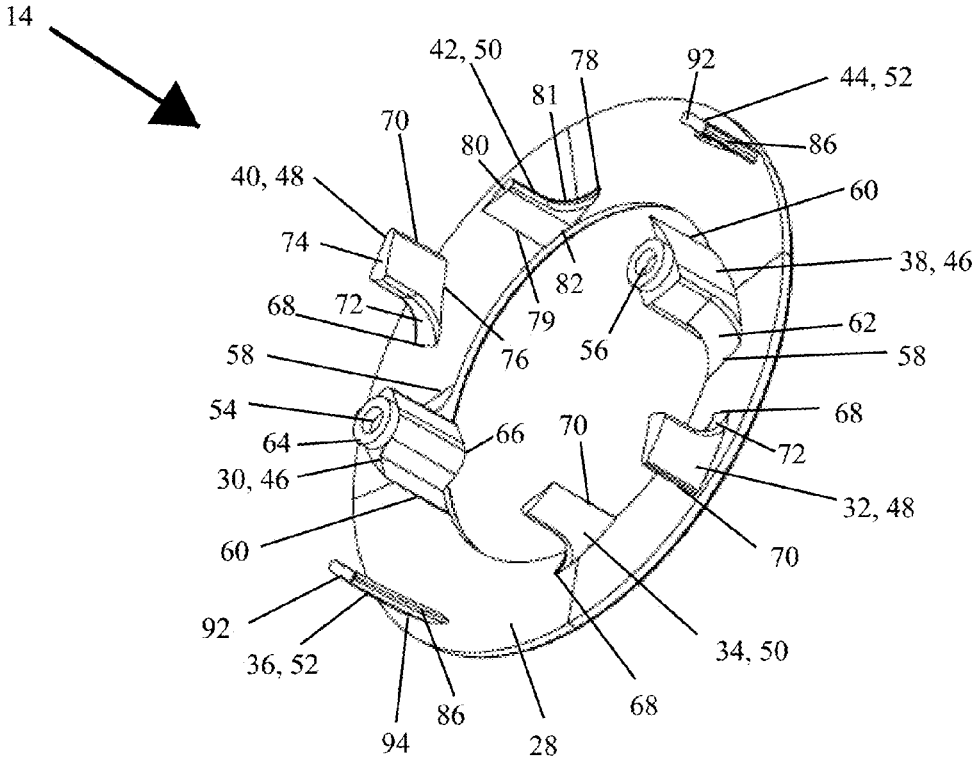
FIG. 5 is a bottom perspective view of the drain plate that is part of the of the drain assembly of FIG. 1.
Figure 6:
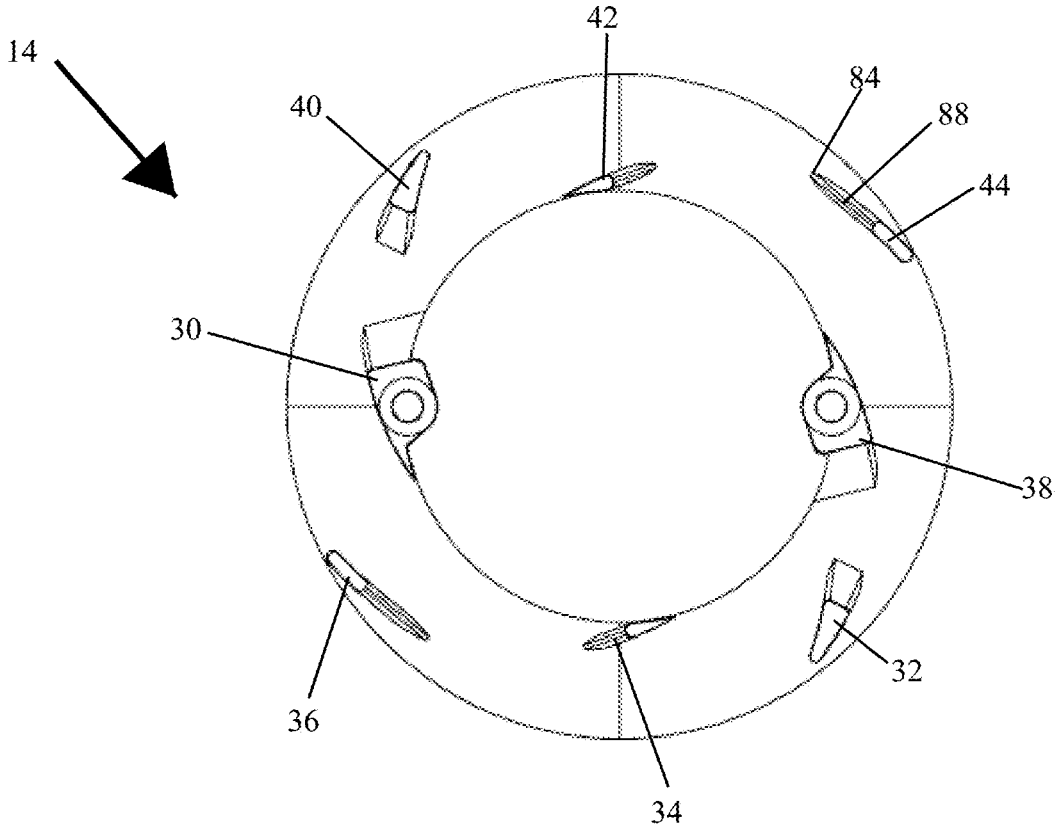
FIG. 6 is a bottom view of the drain plate that is part of the of the drain assembly of FIG. 1.
Figure 7:
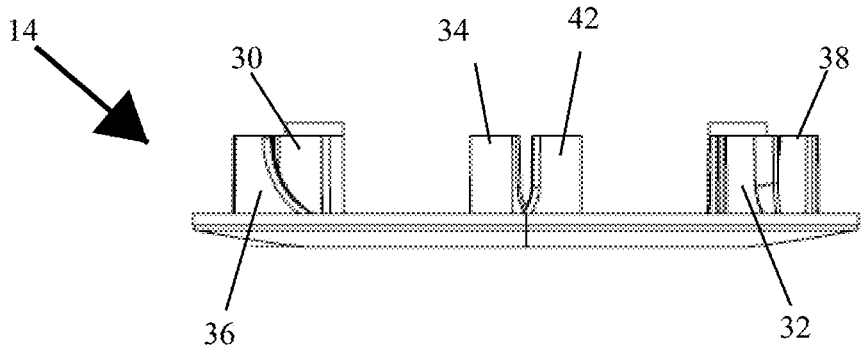
FIG. 7 is a side view of the drain plate that is part of the of the drain assembly of FIG. 1.

As shown in an embodiment in FIG. 5, there are four pairs of fins, including a first pair of fins 46, a second pair of fins 48, a third pair of fins 50, and a fourth pair of fins 52 that extend about a circumference of the drain plate 14 from the bottom surface 28. In an embodiment, the first pair of fins 46 and the third pair of fins 50 are orientated in a counterclockwise direction and the second pair of fins 48 and the fourth pair of fins 52 are orientated in a clockwise direction. Each of the pairs of fins 46, 48, 50, 52 has a different shape to aid in efficiently and effectively controlling the flow of water through the drain assembly 10.

The first pair of fins 46 are arranged at a first angle at the inner periphery of the body 12. Each of the fins 30, 38 of the first pair 46 include a through bore 54, 56 for fastening the drain plate 14 to the first connector 16. The fins 30, 38 include a first end 58 and a second end 60. The first end 58 includes a surface 62 which slopes downwardly and flares outwardly in a circumferential direction at a first angle from a distal end 64 toward a proximal end 66 of the fins 30, 38.

Figure 4:
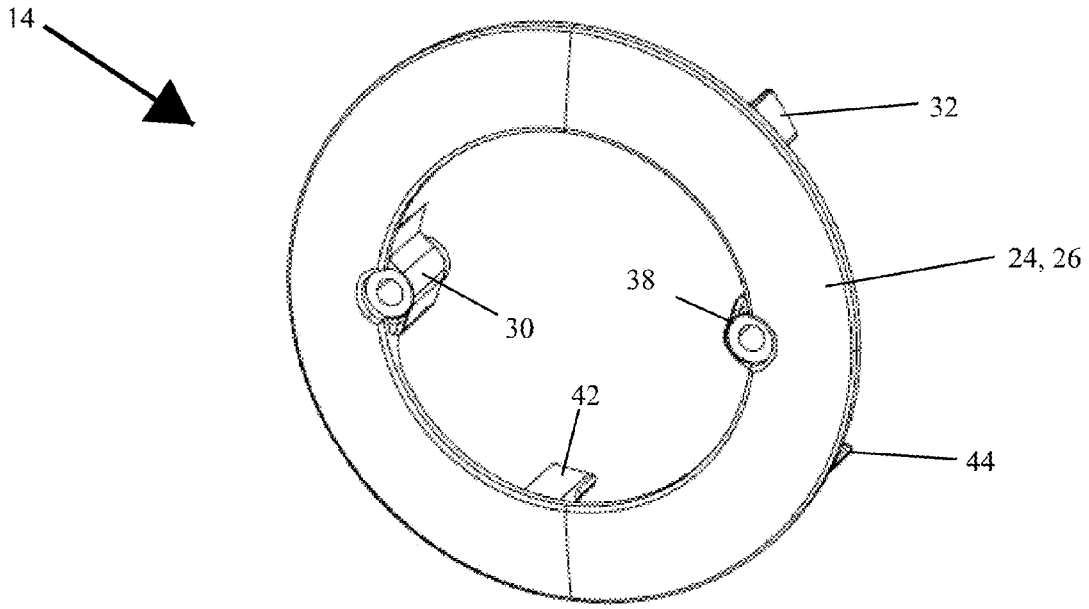
FIG. 4 is a top perspective view of a drain plate that is part of the of the drain assembly of FIG. 1.

The second pair of fins 48 are spaced circumferentially between the first pair of fins 46 and the third pair of fins 50 and orientated at a second angle near the outer periphery of the body 12. Each of the fins 32, 40 of the second pair 48 includes a first end 68 and a second end 70. As shown in FIG. 4, the first end 68 of each the fins 32, 40 includes a surface 72 which slopes downwardly and outwardly from a distal end 74 toward a proximal end 76 at a second angle. Each of the fins 32, 40 are also tapered such that the second end 70 has a narrower width that the first end 68.

The third pair of fins 50 are spaced circumferentially between the second pair of fins 48 and the fourth pair of fins 52 and orientated at a third angle that is at least partially adjacent to the inner periphery of the body 12. Each of the fins 34, 42 of the third pair 50 includes a first end 78 and a second end 79. As shown in FIG. 4, the first end 78 of each the fins 34, 42 includes a surface 81 which slopes downwardly from a distal end 80 toward a proximal end 82 at a third angle.

The fourth pair of fins 52 are spaced circumferentially between the third pair of fins 50 and the first pair of fins 46 and orientated at a fourth angle near the outer periphery of the body 12. Each of the fins 36, 44 of the fourth pair 52 includes a first end 84 and a second end 86. As shown in FIG. 4, the first end 84 of each the fins 38, 44 includes a surface 88 which slopes downwardly from a distal end 92 to a proximal end 94 at a fourth angle.

The varying orientation, size and shape of the fins 30, 32, 34, 36, 38, 40, 42, 44 aids in improving the flow dynamics of the drain assembly 10 and minimizes water surface tension by controlling the flow of water attempting to pass through the drain assembly 10. As a result, the fins 30, 32, 34, 36, 38, 40, 42, 44 efficiently and effectively control both the water flow and air flow through the drain assembly 10 to ensure water passes through the drain assembly 10 at maximum efficiency.

In addition, due to the angular momentum of the water flow directed by the fins 30, 32, 34, 36, 38, 40, 42, 44, any debris, such as hair that would regularly collect over openings in a standard known drain cover and which prevents air flowing out of the openings, can easily pass through the drain without causing any clogging any of the plumbing associated with the drain assembly. By removing debris that can block the openings in a drain simultaneously while controlling the flow of water through the drain, the assembly can continuously operate efficiently to ensure that water flows downward while air flows upward.

In an embodiment, the drain assembly 10 may include a cutting device therein to cut hair or other debris into small segments, further eliminating its ability to clog the drain assembly 10. This cutting device can be rotationally driven by a water vortex or by the flow of water from the source (e.g., a rotary fin device fitted to the cold water supply).

Figure 8:
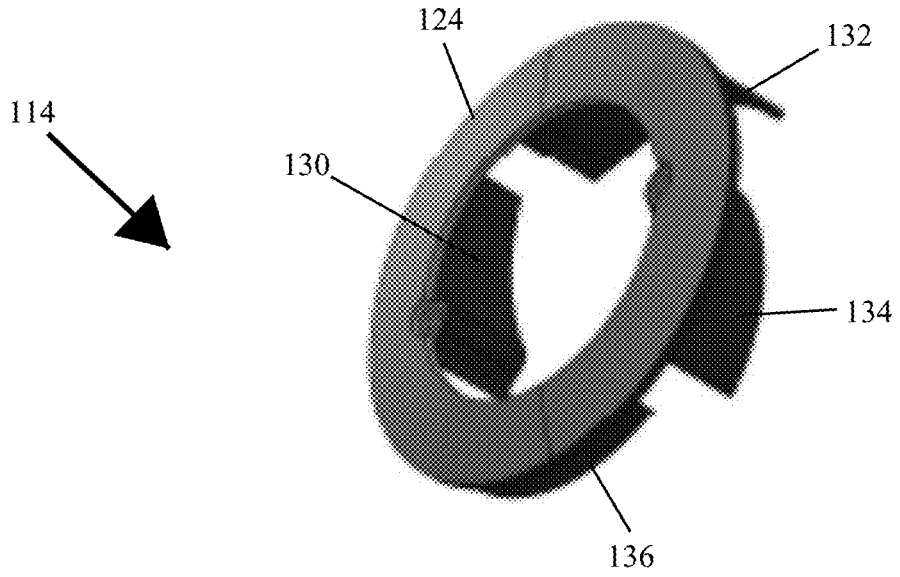
FIG. 8 is a top perspective view of another embodiment of a drain plate.
Figure 9:
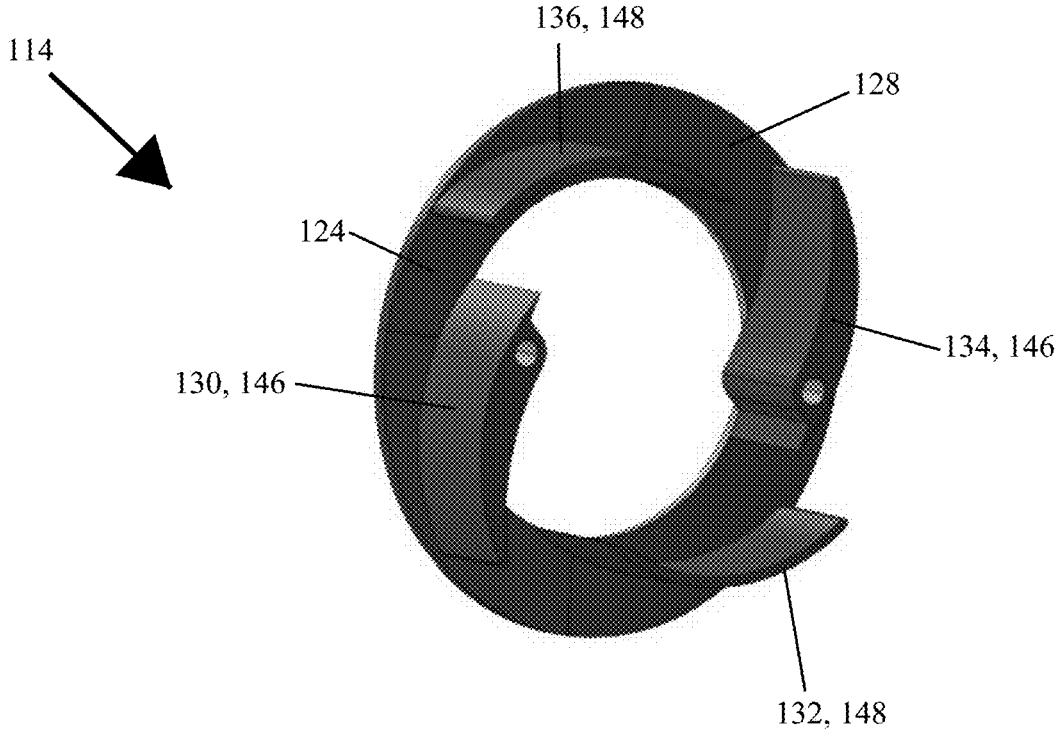
FIG. 9 is a bottom perspective view of the drain plate of FIG. 7.

In an embodiment in FIGS. 8 and 9, a drain plate 114 is shown that includes a body 124 that has a top surface 126 and a bottom surface 128 with a plurality of fins 130, 132, 134, 136 extending from the bottom surface 128 of the drain plate 114. The fins 130, 132, 134, 136 are designed to aid in the control of angular momentum of water.

As shown in FIGS. 9 and 10, two pairs of fins, including a first pair of fins 146 and a second pair of fins 148, extend about a circumference of the drain plate 114 from the bottom surface 128. In an embodiment, both pairs of fins 146, 148 are orientated in substantially opposite directions. Each of the pair of fins 146 and 148 has a different shape to aid in efficiently and effectively controlling the flow of water through a drain assembly.

The first pair of fins 146 extend convexly from approximately an inner periphery toward the outer periphery of the body 112. Each of the fins 130, 138 of the first pair 148 include a through bore 154, 156 for fastening the drain plate 114 to a connector. The fins 130, 138 each taper towards a first end 158 and a second end 160 that extend about the inner periphery.

The second pair of fins 148 extend convexly from approximately an outer periphery toward the inner periphery of the body 112. Each of the fins 132, 140 of the second pair 150 has a substantially uniform body that tapers at a first end 162 near the inner periphery.

The foregoing description and accompanying drawings illustrate the principles, exemplary embodiments of the invention. However, the invention should not be construed as being limited to the particular embodiments discussed herein. Additional variations of the embodiments will be appreciated by those skilled in the art and the above-described embodiments should be regarded as illustrative rather than restrictive. Accordingly, it should be appreciated that variations to those embodiments can be made by those skilled in the art without departing from the scope of the invention.

What is claimed is:

1. A drain assembly, comprising:

a first coupling element;

a drain plate connectable to the first coupling element and including a body extending between an inner periphery and an outer periphery and having a first surface, a second surface opposing the first surface and a plurality of protrusions extending from the second surface at a plurality of angles; and a drain cover connectable to the drain plate, wherein the first surface and the second surface are each sloped downwardly from the inner periphery toward the outer periphery of the body.

2. The drain assembly of claim 1, wherein the body of the drain plate has an opening defining the inner periphery thereof.

3. The drain assembly of claim 1, wherein the protrusions are fins.

4. The drain assembly of claim 3, wherein each of the fins includes a first end sloping toward the second surface and a second end extending vertically away from the second surface.

5. The drain assembly of claim 1, wherein the protrusions are fins that include a first pair of fins orientated in a first direction, a second pair of fins orientated in a second direction, a third pair of fins orientated in a third direction and a fourth pair of fins orientated in a fourth direction.

6. The drain assembly of claim 5, wherein the first pair of fins are orientated at approximately the inner periphery of the body, the second pair of fins are spaced circumferentially toward the outer periphery of the body between the first pair of fins and the third pair of fins, the third pair of fins are spaced circumferentially toward the inner periphery of the body between the second pair of fins and the fourth pair of fins and the fourth pair of fins are spaced circumferentially between the third pair of fins and the first pair of fins toward the outer periphery of the body.

7. The drain assembly of claim 5, wherein the first pair of fins each include a through bore for fastening the drain plate.

8. The drain assembly of claim 5, wherein at least one of the pairs of fins has a width that tapers from a first end toward a second end.

9. The drain assembly of claim 1, further comprising a second coupling element connectable with the first coupling element.

10. The drain assembly of claim 1, further comprising a sealing washer and a friction washer arranged between the first coupling element and the second coupling element.

11. A drain plate, comprising:

a body extending between an inner periphery and an outer periphery and having a first surface, a second surface opposing the first surface and a plurality of protrusions extending from the second surface at a plurality of angles that are configured to aid in a flow of water through a drain assembly, wherein the first surface and the second surface are sloped downward from the inner periphery toward the outer periphery of the body.

12. The drain assembly of claim 11, wherein the body has an opening defining the inner periphery thereof.

13. The drain assembly of claim 12, wherein the protrusions are fins.

14. The drain assembly of claim 13, wherein each of the fins includes a first end sloping toward the second surface and a second end extending vertically away from the second surface.

15. The drain assembly of claim 11, wherein the protrusions are fins that include a first pair of fins orientated in a first direction, a second pair of fins orientated in a second direction, a third pair of fins orientated in a third direction and a fourth pair of fins orientated in a fourth direction.

16. The drain assembly of claim 15, wherein the first pair of fins are orientated at approximately an inner periphery of the body, the second pair of fins are spaced circumferentially toward the outer periphery of the body between the first pair of fins and the third pair of fins, the third pair of fins are spaced circumferentially toward the inner periphery of the body between the second pair of fins and the fourth pair of fins and the fourth pair of fins are spaced circumferentially between the third pair of fins and the first pair of fins toward the outer periphery of the body.

17. The drain assembly of claim 15, wherein the first pair of fins each include a through bore for fastening the drain plate.

18. The drain assembly of claim 15, wherein at least one of the pairs of fins has a width that tapers from a first end toward a second end.

19. A drain plate, comprising:

a body extending between and delimited at an inner periphery and an outer periphery and including a first surface, a second surface opposing the first surface and a plurality of fins extending from the second surface at a plurality of angles to aid in a flow of water through a drain assembly, each of the fins includes a first end sloping toward the second surface of the body and a second end extending vertically away from the second surface of the body.

* * * * *